US008875753B2

(12) United States Patent
Norris

(10) Patent No.: US 8,875,753 B2
(45) Date of Patent: Nov. 4, 2014

(54) METHOD AND APPARATUS FOR MAKING LAYERED DRINKS

(76) Inventor: David Norris, Rocky River, OH (US)

( * ) Notice: Subject to any disclaimer, the term of this patent is extended or adjusted under 35 U.S.C. 154(b) by 629 days.

(21) Appl. No.: 13/193,236

(22) Filed: Jul. 28, 2011

(65) Prior Publication Data

US 2013/0025738 A1 Jan. 31, 2013

(51) Int. Cl.
*B67C 11/02* (2006.01)
*A47G 21/00* (2006.01)

(52) U.S. Cl.
CPC ..... *B67C 11/02* (2013.01); *A47G 21/00* (2013.01)
USPC ..... 141/333; 141/2; 141/339

(58) Field of Classification Search
CPC ..... B65B 1/04; B67C 11/02
USPC ..... 141/1, 331, 33, 339, 341–342, 333; 222/129.4
See application file for complete search history.

(56) References Cited

U.S. PATENT DOCUMENTS

| | | | | | |
|---|---|---|---|---|---|
| 102,050 | A | * | 4/1870 | Scantlin | 141/340 |
| 374,875 | A | * | 12/1887 | Lyman | 210/472 |
| 1,368,640 | A | * | 2/1921 | Melchior | 141/340 |
| 1,522,167 | A | * | 1/1925 | Young | 141/98 |
| D205,236 | S | * | 7/1966 | Fitzwilliam | D7/700 |
| D205,678 | S | * | 9/1966 | Williams | D7/700 |
| 3,844,720 | A | * | 10/1974 | Jones | 422/550 |
| 4,022,257 | A | * | 5/1977 | O'Connell | 141/98 |
| 4,050,484 | A | * | 9/1977 | Danyo | 141/34 |
| 4,999,109 | A | * | 3/1991 | Sabre | 210/244 |
| 5,195,567 | A | * | 3/1993 | Tyree, Jr. | 141/331 |
| 5,293,912 | A | * | 3/1994 | Wildash et al. | 141/344 |
| 5,322,097 | A | * | 6/1994 | Wright | 141/199 |
| 5,497,814 | A | * | 3/1996 | Cannon | 141/331 |
| 5,535,793 | A | * | 7/1996 | Tantre | 141/337 |
| 5,609,189 | A | * | 3/1997 | Sternheimer et al. | 141/1 |
| 5,937,919 | A | * | 8/1999 | Zavos et al. | 141/100 |
| 5,947,004 | A | * | 9/1999 | Huang | 99/299 |
| 6,419,112 | B1 | * | 7/2002 | Bruce et al. | 220/781 |
| 2006/0065758 | A1 | * | 3/2006 | Hamer | 239/33 |
| 2009/0211662 | A1 | | 8/2009 | Haramis et al. | |
| 2013/0025738 | A1 | * | 1/2013 | Norris | 141/1 |
| 2013/0056476 | A1 | * | 3/2013 | Buck | 220/592.2 |
| 2013/0119065 | A1 | * | 5/2013 | Buck | 220/523 |

* cited by examiner

*Primary Examiner* — Timothy L Maust
*Assistant Examiner* — Andrew Schmid
(74) *Attorney, Agent, or Firm* — Howard M. Cohn; Daniel Cohn

(57) ABSTRACT

A layering device for producing a layered drink in a drinking container may include a hollow cup with an open top. A circumferential sealing rib may be formed on an exterior surface of a wall of the cup. An opening through the wall may be positioned axially between the rib and the open top of the cup. An outer diameter of the rib may engage with an interior surface of the drinking container.

16 Claims, 2 Drawing Sheets

METHOD AND APPARATUS FOR MAKING LAYERED DRINKS

BACKGROUND OF THE INVENTION

The present invention generally relates to layering different types of liquors and liqueurs into a shot glass.

In the field of preparing and serving alcoholic drinks it useful to provide drinks with a pleasing and novel appearance. In this regard, drinks are sometimes prepared in a layered configuration. A colorful liqueur may be placed in a glass and a second liqueur with a different color may be carefully poured into the same glass so that the second liqueur forms a layer on top of the first liqueur. A preparer of such a drink must be very careful in pouring the second liqueur so as not to allow the two liquids to co-mingle. Even when an experienced preparer attempts to make a layered drink, there is a substantial risk that the liqueurs may co-mingle and the drink materials may then need to be discarded.

As can be seen, there is a need for a system of preparing layered drinks which may be performed by a relatively inexperienced person and which may be performed with a high probability of success. Furthermore there is a need for a system in which a drink can be made with more than two layers.

SUMMARY OF THE INVENTION

In one aspect of the present invention, a layering device for producing a layered drink in a drinking container may comprise: a hollow cup with an open top; a circumferential sealing rib formed on an exterior surface of a wall of the cup; and an opening through the wall, the opening being positioned axially between the rib and the open top of the cup, and an outer diameter of the rib being large enough so that the rib engages with an interior surface of the drinking container.

In another aspect of the present invention, apparatus for drink layering may comprise: a drinking glass with a tapered interior surface; a hollow cup with an open top; a circumferential sealing rib formed on an exterior surface of the wall of the cup and having an outer diameter smaller than a maximum interior diameter of the glass and larger than a minimum interior diameter of the glass; and an opening through a wall of the cup, the opening being positioned axially between the rib and an open top of the cup.

In still another aspect of the invention, a method for making a layered drink may comprise the steps of: providing for inserting a liquid holder into a glass with a tapered interior surface; providing for engaging a circumferential rib of the holder against the interior surface; and providing for releasing fluid from the holder into the glass by raising the holder out of the glass so that fluid emerges from the holder around the rib and onto the interior surface of the glass.

These and other features, aspects and advantages of the present invention will become better understood with reference to the following drawings, description and claims.

DETAILED DESCRIPTION OF THE INVENTION

Figure 1:
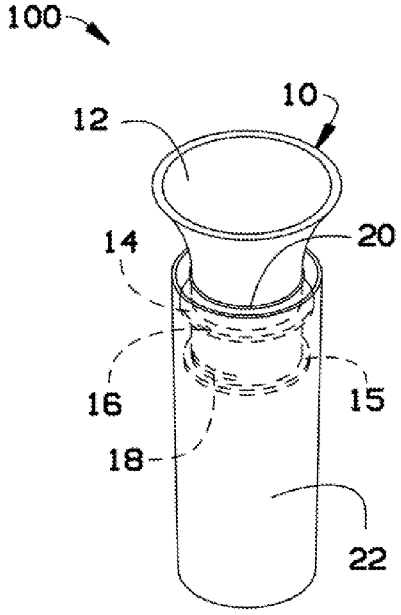
FIG. 1 is a perspective view of an apparatus for making a layered drink in accordance with an embodiment of the invention.
Figure 2:
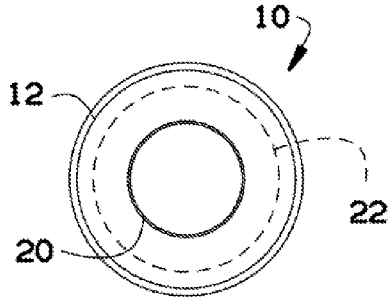
FIG. 2 is a top view of the apparatus of FIG. 1.
Figure 3:
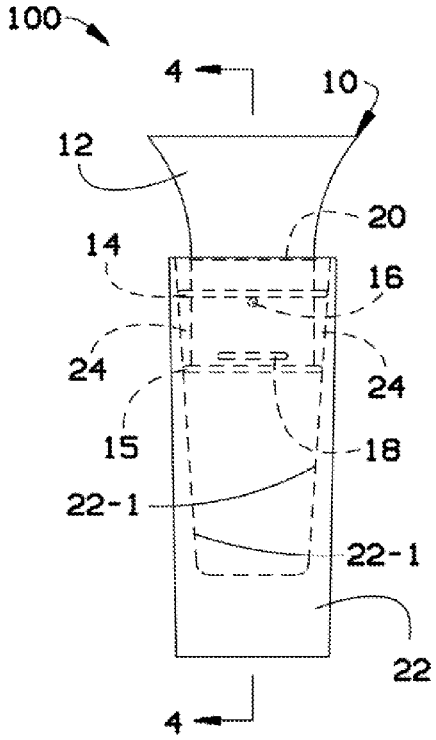
FIG. 3 is an elevation view of the apparatus of FIG. 1.
Figure 4:
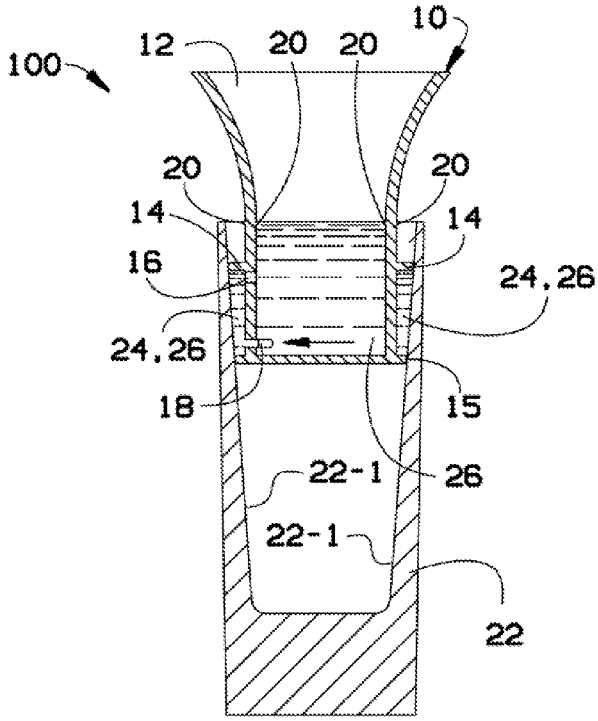
FIG. 4 is cross sectional view of the apparatus of FIG. 1.
Figure 5:
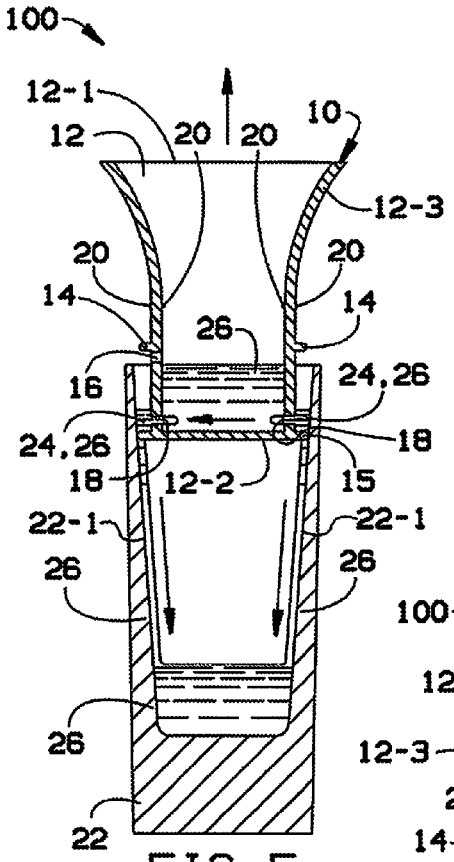
FIGS. 5 and 6 are cross-sectional views of the apparatus of FIG. 1 illustrating operational features.
Figure 7:
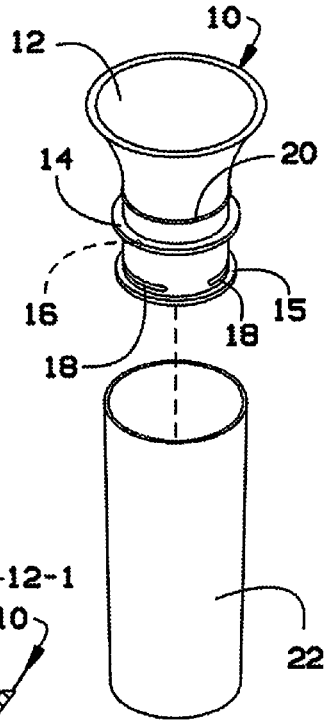
FIG. 7 is a second perspective view of the apparatus of FIG. 1.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, embodiments of the present invention generally provide a funnel shaped holder into which liquid may be poured and then released into a glass so that the released liquid may form a layer on top of pre-existing liquid that may be in the glass.

Referring now to the Figures, it may be seen that an exemplary embodiment of a drink layering apparatus 100 may comprise a layering device or liquid holder 10 and a drinking container or glass 22. The holder 10 may comprise a funnel-shaped cup 12, an upper circumferential rib 14, a lower circumferential sealing rib 15, a vent hole 16 and one or more fluid outflow openings or slots 18. The cup 12 may have a top 12-1, a bottom 12-2 and a wall 12-3. In an exemplary embodiment, the glass 22 may be a shooter style shot glass with a tapered interior. A top maximum interior diameter of the glass 22 may be about 1.625 inch, and a minimum bottom interior diameter may be about 1.375 inch. The lower rib 15 of the holder 10 may have an outer diameter such that the lower rib 15 may engage with and seal against an inner surface 22-1 of the glass 22 when the holder 10 is lowered into the glass 22. The upper rib 14 may also engage with the inner surface 22-1 and provide vertical alignment stability for the holder 10. In an exemplary embodiment, the holder 10 may be constructed from food grade semi-rigid (e.g. about 70 Durometer) plastic material. Thus the ribs 15 may be flexible enough so that they may seal against the interior surface 22-1 of one of the glasses 22 even if the interior surface 22-1 is not perfectly circular.

In operation, the holder 10 may be placed into the glass 22 so that the lower rib 15 may seal against the inner surface 22-1 of the glass. The upper rib 14 may also engage with the inner surface 22-1 and provide vertical alignment stability for the holder 10. A first liquid 26 may be poured into the holder 10 to fill the holder up to fill line 20. The liquid 26 may pass through the slots 18 and into a containment region 24 between the ribs 14 and 15 and the inner surface 22-1. The vent hole 16 may allow air to pass out of the containment region 24 as the liquid 26 enters the region 24.

After the holder 10 is suitably filled, the holder 10 may be slowly lifted. As lifting proceeds, the rib 15 may become disengaged from the interior surface 22-1 thus allowing the liquid 26 to begin flowing downwardly along the interior surface 22-1. The liquid 26 may flow along the entire periphery of the interior surface 22-1. The wall 12-3 of the cup 12 may be provided with two of the slots 18 which may be diametrically opposed so that the liquid 26 may flow uniformly out of the cup 12. Consequently, the liquid 26 may flow as controlled laminar flow and not as turbulent flow.

After the holder 10 is emptied of the liquid 26, the holder 10 may be completely removed from the glass 22 and then rinsed. Then the holder 10 may be reinserted into the glass 22 and filled with a second liquid 28 having a density different from the first liquid 26. The second liquid 28 may be released into the glass 22 with laminar flow as described above with respect to the liquid 26. Because the liquid 28 may flow in a non-turbulent manner, the liquid 28 may form a distinct layer on top of the liquid 26.

Figure 6:
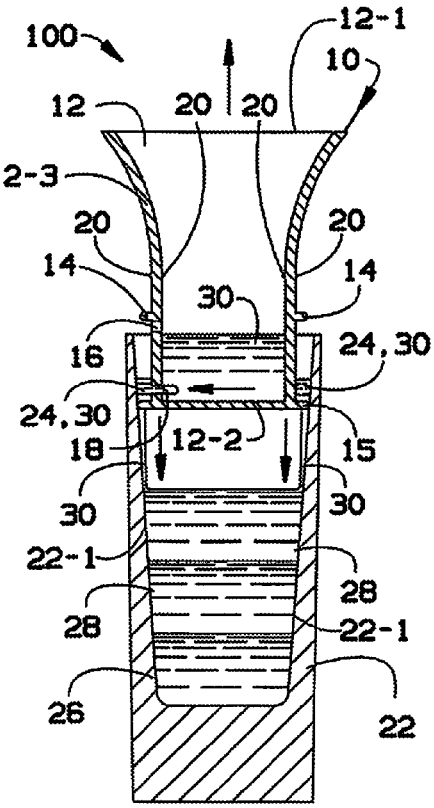

Similarly, as shown in FIG. 6, a third liquid 30 may be layered onto the liquid 28 after removal, rinsing and reinsertion of the holder 10 into the glass 22.

It should be understood, of course, that the foregoing relates to exemplary embodiments of the invention and that modifications may be made without departing from the spirit and scope of the invention as set forth in the following claims.

What is claimed is:

1. A device in combination with a drinking container for producing a layered drink comprising:

a hollow cup with an open top;

a lower circumferential sealing rib formed on an exterior surface of a wall of the cup, an outer diameter of the lower circumferential sealing rib designed to engage with and seal against a tapered interior surface of the drinking container; and an opening through the wall of the cup positioned axially between the lower circumferential sealing rib and the open top of the cup.

2. The device of claim 1 wherein the wall of the cup is funnel shaped.

3. The device of claim 1 further comprising an upper circumferential rib formed on the exterior surface of the wall of the cup designed to engage with and seal against the tapered interior surface of the drinking container and positioned axially between the open top of the cup and the opening through the wall of the cup.

4. The device of claim 1 wherein the opening through the wall of the cup comprises two slots positioned diametrically across from one another.

5. The device of claim 1 comprising food grade semi-rigid plastic.

6. Apparatus for layering liquids in a drinking container comprising:

the drinking container having a tapered interior surface;

a hollow cup with an open top;

a lower circumferential sealing rib formed on an exterior surface of a wall of the cup and having an outer diameter smaller than a maximum interior diameter of the drinking container and larger than a minimum interior diameter of the drinking container, the outer diameter of the lower circumferential sealing rib designed to engage with and seal against the tapered interior surface of the drinking container; and an opening through the wall of the cup being positioned axially between the lower circumferential sealing rib and the open top of the cup.

7. The apparatus of claim 6 further comprising an upper circumferential rib formed on the exterior surface of the wall of the cup designed to engage with and seal against the tapered interior surface of the drinking container and positioned axially between the top of the cup and the opening through the wall of the cup.

8. The apparatus of claim 7 wherein the lower circumferential sealing rib and the upper circumferential rib are spaced apart axially to form a containment region when the cup is inserted in the drinking container.

9. The apparatus of claim 8 wherein the containment region is provided with an air vent through the wall of the cup.

10. The device of claim 3 wherein the lower circumferential sealing rib and the upper circumferential rib are spaced apart axially to form a containment region when the cup is inserted in the drinking container having a tapered interior surface.

11. The device of claim 10 wherein the containment region is provided with an air vent through the wall of the cup.

12. A method for making a layered drink comprising the steps of:

inserting a hollow cup with an open top into a drinking container with a tapered interior surface;

engaging and sealing a lower circumferential sealing rib of the hollow cup against the tapered interior surface of the drinking container;

pouring fluid into the open top of the hollow cup; and releasing the fluid from the hollow cup into the drinking container by raising the hollow cup out of the drinking container so that the lower circumferential sealing rib of the hollow cup disengages from against the tapered interior surface of the drinking container so that the fluid flows through at least one opening through the wall of the cup being positioned axially between the lower circumferential sealing rib and the open top of the cup and downward from the hollow cup around the lower circumferential sealing rib and onto the tapered interior surface of the drinking container.

13. The method of claim 12 including:

providing an upper circumferential rib formed on the exterior surface of the wall of the cup;

engaging and sealing upper circumferential rib against the tapered interior surface of the drinking container and positioned axially between the top of the cup and the at least one opening through the wall of the cup.

14. The method of claim 13 including:

spacing the lower circumferential sealing rib and the upper circumferential rib apart axially thereby forming a containment region when the cup is inserted in the drinking container.

15. The method of claim 14 including:

allowing air to pass out of the containment region through an air vent through the wall of the cup as the fluid enters the containment region.

16. The method of claim 12 including pouring the fluid into the holder to fill the holder up to a fill line.

* * * * *